US005379273A

United States Patent [19]

Horinek

[11] Patent Number: 5,379,273

[45] Date of Patent: Jan. 3, 1995

[54] ALARM CLOCK SYSTEM

[76] Inventor: Kevin D. Horinek, 1311 Summertime, Lewisville, Tex. 75067

[21] Appl. No.: 226,882

[22] Filed: Apr. 13, 1994

[51] Int. Cl.[6] ..... G04C 21/00; G04B 23/00

[52] U.S. Cl. ..... 368/73; 368/262

[58] Field of Search ..... 368/72-74, 368/250, 251, 261-262

[56] References Cited

U.S. PATENT DOCUMENTS 4,218,875 8/1980 Rothman ..... 368/73

4,316,273 2/1982 Jetter ..... 368/47

4,426,157 1/1984 Jetter ..... 368/73

*Primary Examiner*—Vit W. Miska

*Attorney, Agent, or Firm*—S. Pal Asija; Larry L. Uland

[57] ABSTRACT

An alarm clock system with a remote control is provided, which includes an alarm clock base unit with an audible alarm, and a remote controller for suspending, or delaying, operation of an activated alarm signal. A limited number of times in which such delaying of the alarm signal can be activated may be preselected, for stimulating the operator to rise out of bed in order to deactivate the alarm.

20 Claims, 3 Drawing Sheets

ALARM CLOCK SYSTEM

This is related to the disclosure filed with the U.S. Patent and Trademark Office as part of the Disclosure Document Program on May 3, 1993, having Ser. No. 333,252.

BACKGROUND OF THE INVENTION

The present invention relates to the field of alarm clocks, and more particularly to an alarm clock incorporating an alarm delay feature, in which an activated alarm signal is rendered inoperative for a period of time, and then automatically reactivated. The present invention further incorporates a remote controller for the activation of such a delay feature.

For most people, the beginning of a work day is announced by an alarm clock. However, the transition from sleep to wakefulness is difficult for many people, and numerous practices and devices have been implemented with the intention of facilitating this transition. Some people use alarm clocks with unpleasant or extraordinarily loud audible signals, to jar the sleeper awake. Others place their alarm clocks at a distance from their beds, so that physical activity is required to deactivate the alarm. Such abrupt methods of waking the sleeper are undesirable to many. For a more gentle transition to wakefulness many "clock radios" are available, in which a radio and an alarm clock are incorporated into a single unit. In most of these devices the user may choose to be awakened by music from a radio broadcasting station of their choice, rather than by a traditional alarm signal. Unfortunately, this approach, while gentle, often results in oversleeping, as it is easy for many to continue to sleep in the presence of music. Indeed, music is often used to encourage sleep.

A middle ground between the abrupt and gentle approach to alarm clocks is found in the use of a "snooze button," by which an activated alarm signal is rendered temporarily inoperative, affording the sleeper additional rest after being initially awakened, and thereby allowing a sleeper opportunity to awaken gradually. In current implementations of such a delay feature, the snooze button is located on the alarm clock, which is then placed in close proximity to the sleeper, to allow the snooze feature to be activated without the sleeper getting out of bed. Unfortunately, convenient use of such a snooze feature requires placement of the clock within close proximity to the user, which can result in several problems First, such placement of the alarm clock unit allows for repeated use of the snooze feature, which can result in oversleeping. Close proximity of the alarm clock unit to the sleeper also allows for easy permanent deactivation of the alarm signal, which again can result in oversleeping. In addition, the common use of luminous or lighted displays for nighttime visibility can prove a significant impediment to sleep when such displays are close to the sleeper. Finally, having to place the alarm clock unit near the sleeper can limit visibility of the time information from other vantage points within the room, as well as conflict with more aesthetic considerations. Although these problems are well known in the art, none of the existing alarm clocks which incorporate a delay or snooze feature address said problems with the same degree of success as the present invention.

Examples of prior art alarm clocks with some kind of remote controller include that taught in U.S. Pat. No. 4,316,273 by Jetter, which proposes a local alarm signal unit, placed in close proximity to the sleeper, with a remote unit containing means for deactivating the alarm. The remote placement of the deactivating unit forces the sleeper to get out of bed and move to the location of the deactivating unit in order to stop the alarm signal. In this teaching the awakened person is further required to hold the deactivation switch for several seconds, for the purpose of insuring the operator has thoroughly awakened, and thus preventing oversleeping. Once the deactivation requirements have been met, the disabling of the alarm signal is permanent. The teaching of Jetter further requires that the sleeper either get up immediately and satisfy the requirements for deactivating the alarm system, or otherwise endure the alarm signal. Thus, the teaching of Jetter uses separation of the alarm deactivating means from the alarm signal means in order to abruptly force wakefulness upon the user. Unlike the present invention, allowance is not made in this prior art teaching for causing a delay in the alarm, which denies the sleeper an opportunity to awaken gradually.

Another prior art device in which an alarm clock system is separated into two elements is disclosed by Rothman in U.S. Pat. No. 4,218,875. In this invention, the alarm signal portion of the alarm clock is demountably attached to a clock, and is adapted to be removed from the clock and thrown against a surface without harm to the alarm signal unit. In this teaching, the alarm signal is deactivated following impact of the alarm signal unit with a surface. Thus a cathartic device is provided for a sleeper who is annoyed by the alarm signal, and also provides a novel means for deactivating the alarm. This invention does not, however, provide a means for gradually bringing the sleeper to wakefulness. Also, the invention proposed by this teaching does not help prevent termination of the alarm signal prematurely, that is, before the sleeper is fully awakened. Finally, this invention does not provide remote control over the alarm, as the throw-able portion of the alarm must be attached to the base unit during the inactive period of the alarm.

While the alarm clock systems in the prior art may satisfy some purposes for which they were designed, they would not be as suitable for the purposes of the present invention as hereinafter described. One of the most important desirable characteristics of an alarm clock system is to ensure that the sleeper comes to full wakefulness by a desirable time, without making the transition from sleep to wakefulness overly abrupt or unpleasant. The present invention makes use of a portable remote control element for delaying the operation of an activated alarm signal of the alarm clock, from a location which is apart from the base unit of the alarm clock. This allows for placement of the alarm clock base unit in a location away from the sleeper, for incorporation of the requirement to rise out of bed and touch said base unit as part of the alarm deactivating protocol for insuring an effective sleep-to-wakefulness transition. Another significant advantage provided by this aspect of the present invention is that the alarm clock base unit can be placed in any convenient location, providing for optimum visibility and aesthetic considerations, with the remote control element providing means for temporarily deactivating the alarm signal. Yet another advantage of the present invention is that oversleeping is prevented by limiting the number of times that the alarm delay signal of the remote control element may be effective, respective to initial activation of the audible alarm signal at a selected preferred alarm time. None of the prior art devices achieve these results as successfully or in the manner proposed by the present invention.

SUMMARY OF THE INVENTION

In view of the foregoing disadvantages inherent in the known types of alarm clock systems now present in the art, the invention disclosed herein provides a new and improved alarm clock system having means for delaying an activated alarm signal. The system of the present invention includes an alarm clock base unit with an audible alarm, and a remote controller for suspending, or delaying, operation of the activated alarm signal. As such, the general purpose of the present invention, which is described in greater detail below, is to provide an alarm clock system that allows placement of the alarm clock in a convenient location, while at the same time allowing remote activation of an alarm delay feature. Means for limiting the number of times the delay can be activated is further provided for insuring said transition from sleep to wakefulness is certain. The present invention thus achieves all of the purposes of the prior art alarm clocks, without suffering their disadvantages. To attain this, representative embodiments of the concepts of the present invention are illustrated in the appended drawings.

It is therefore an object of the present invention to provide a new and improved alarm clock system with a remote controller for delaying operation of an activated audible alarm signal.

It is another object of the present invention to provide an alarm clock system which is capable of limiting the number of times the alarm signal can be delayed.

It is a further object of the present invention to provide an alarm clock system that affords a sleeping person additional rest after initial activation of an alarm, without allowing indefinite postponement of wakefulness.

It is yet a further object of the present invention to provide an alarm clock system with a large, highly visible display that allows placement at any convenient location rather than only in close proximity to the sleeper.

It is yet still a further object of the present invention to provide an alarm clock system which allows the current date to be displayed.

An even further object of the present invention is to provide an alarm clock system which is capable of continued operation after loss of externally supplied electrical power.

Another object of the present invention is to provide an alarm clock system with a remote control capable of displaying the current time.

It is another, further object to provide an alarm clock system which can incorporate a radio, and that will allow remote control of a radio.

It is still a further object of the present invention to provide a new and improved alarm clock system including a standard clock module, said clock module providing the basic timekeeping and alarm functions, thereby reducing the overall cost of the alarm clock system by reducing the number of discreet components required therein.

It is an even further object of the present invention to provide a new and improved alarm clock system which may be easily and efficiently manufactured and marketed.

It is still yet an object of the present invention to provide a new and improved alarm clock system which is of durable and reliable construction.

It is another object of the present invention to provide a new and improved alarm clock system which meets all federal, state, local and other private standards, guidelines, regulations and recommendations with respect to safety, environmental friendliness, energy conservation, etc.

It is an additional object of the present invention to provide a new ant improved alarm clock system which is susceptible of a low cost of manufacture with regard to both materials and labor, and which accordingly is then susceptible of low prices of sale to the consuming public, thereby making such an alarm clock system economically available to the buying public.

These together with other objects of the invention, along with the various features of novelty which characterize the alarm clock system of the present invention, are pointed out with particularity in the claims appended hereto and forming a part of this disclosure. The more important objects of the present invention have been outlined rather broadly in order that the detailed description thereof which follows may be better understood, and in order that the present contribution to the art may be better appreciated. For a better understanding of the invention, its operational advantages, and the specific objects attained by its uses, reference should be made to the accompanying drawings and descriptive matter in which are illustrated various embodiments of the invention. Those skilled in the art will readily ascertain, however, that the invention is capable of other embodiments and of being practiced and carried out in various ways. In this respect, the details of construction disclosed herein, and the arrangements of the components set forth in the following description and appended drawings are for illustrative purposes, only, and are not intended to be limiting in scope.

Those skilled in the art will appreciate, as well, that the conception upon which this disclosure is based, may be readily utilized as a basis for the designing of other structures, methods and systems for carrying out the several purposes of the present invention. Said other structures may include, but are not limited to those which are aesthetic in nature, or those which include the substitution of other materials as they become available, and which substantially perform the same function in substantially the same manner with substantially the same result as the present invention. It is important, therefore, that the claims appended hereto be regarded as including such equivalent structures, constructions, methods, and systems insofar as these do not depart from the spirit and scope of the present invention.

BRIEF DESCRIPTION OF THE DRAWINGS

The invention will be better understood and objects other than those set forth above will become apparent when consideration is given to the following detailed description. Such description makes reference to the appended drawings. wherein.

DETAILED DESCRIPTION OF THE VARIOUS EMBODIMENTS

The present invention comprises an alarm clock system including an alarm clock base unit including means for generating an audible alarm, means for setting and displaying the current time and date, means for setting at least a preferred alarm time, means for enabling the audible alarm such that it is activated at the preferred alarm time, and means for disabling the audible alarm. Further include in the alarm clock base unit are means for delaying continued operation of the audible alarm after it is activated, such that the audible alarm ceases operation and remains inoperative during a preset delay period, after which period the audible alarm resumes operation. The delaying means are responsive to an electronic alarm delay signal which may be precipitated by either local or remote activation means. The alarm clock base unit further includes means for receiving and transforming a remote alarm delay signal into the electronic alarm delay signal. The alarm clock base unit further includes power source means for energizing the various electronic components of the alarm clock base unit, using either line alternating current or a replaceable battery for back-up power in the absence of line current or during an external power failure.

The alarm clock system of the present invention further comprises a remote alarm controller which is physically independent from the alarm clock base unit, and includes means for generating and transmitting said remote alarm delay signal. The remote controller further includes means for setting and displaying the current time, as well as having self-contained power source means for energizing the various electronic components of the alarm remote controller. Said power source means includes a replaceable battery. One of various embodiments of the invention are illustrated in the appended drawings and described in greater detail, below. (All like numerical designations in the figures represent the same element.)

Figure 1A:
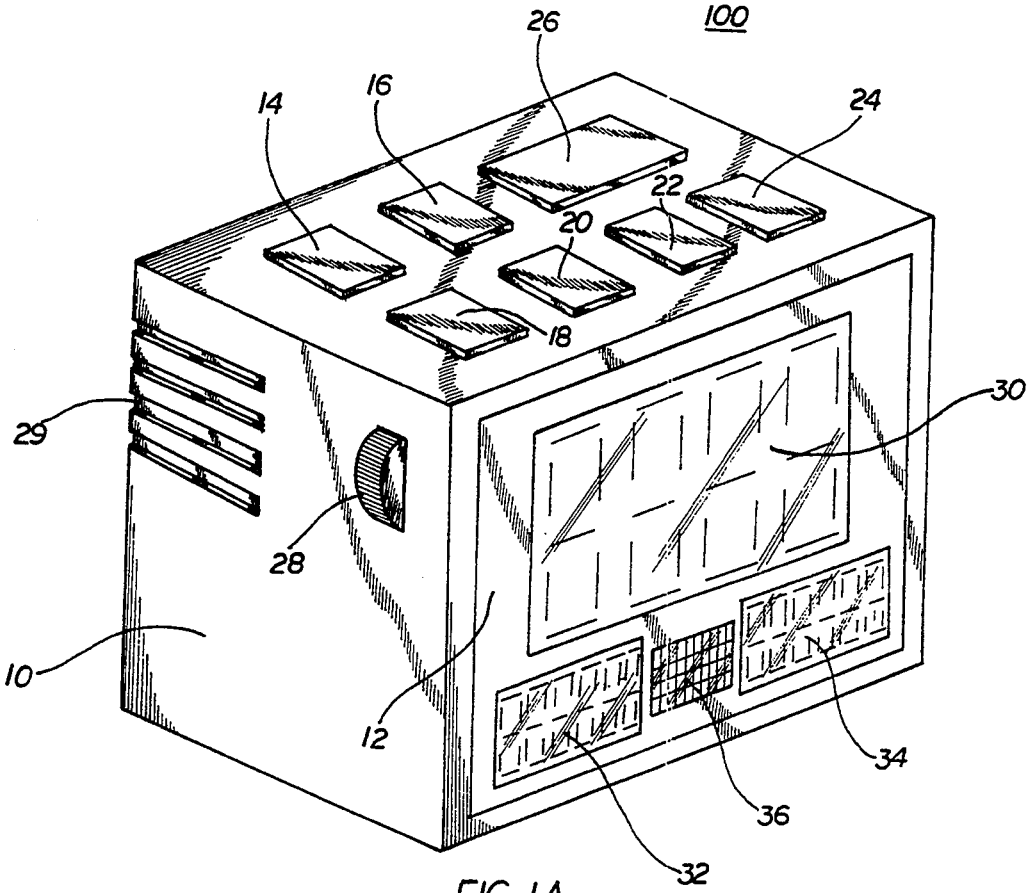
FIG. 1A is a perspective view of an embodiment of a base unit of the alarm clock system according to the present invention.
Figure 1B:
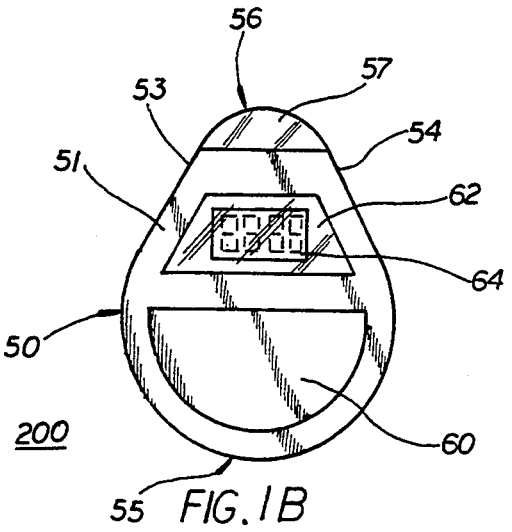
FIGS. 1B and 1C are front and rear elevational views, respectively, of a remote controller for working in conjunction with the base unit of FIG. 1A.
Figure 1C:
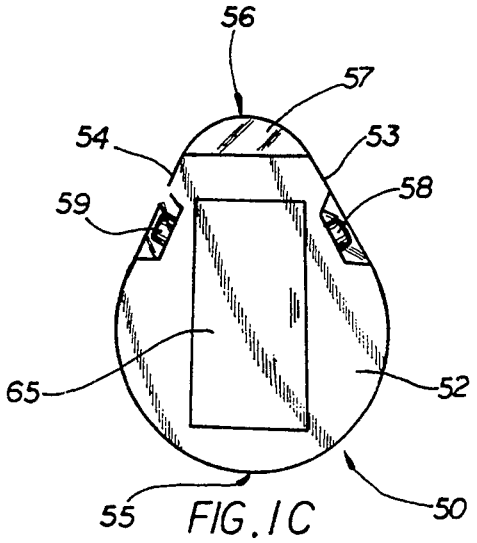

FIG. 1A is a perspective view of an embodiment of the exterior of each of the two physically independent components of the alarm clock system. An embodiment of the exterior of an alarm clock base unit 100 is illustrated in FIG. 1A. and an embodiment of the exterior of a remote alarm controller 200 is illustrated in FIGS. 1B and 1C. The alarm clock base unit 100 comprises an exterior housing 10, which includes in its front face a display panel 12, and on the top of the base unit 100 a plurality of push-button type control keys for controlling various of the alarm clock functions. Said control keys including a time and date setting selection ("TDSS") key 14, a time and date adjustment key 16, an alarm setting selection key 18, an alarm adjustment key 20, an alarm select/enable key 22, an alarm deactivation key 24, and a local alarm-delay key 26. The left side of the base unit 100 includes a control wheel 28 connected to an internally fixed variable resistor, for adjusting the display brightness by suitable rotation of said wheel 28. The left side of the base unit 100 also includes a plurality of horizontal ventilation slots 29 which extend from the back left edge of the base unit 100 toward the front of said unit for allowing escape of air heated by operation of the electronic circuitry contained inside the base unit 100.

Those skilled in the art will be aware of a variety of means which are wellknown and used to select and adjust alarm system parameters, including key means, push-buttons and rotatable dials or wheels, said means including appropriate conditioning circuitry for suitable interfacing to the other clock system electronics. As well, those skilled in the art will recognize various other designs, shapes, sizes and configurations for forming the base unit 100 and the remote alarm controller 200, which may perform in substantially the same manner as the embodiments of those elements described and illustrated herein, according to the present invention, it should be understood, therefore, that the overall aesthetic design, and the choice of selection and adjustment means used in this embodiment of the present invention are not intended to be limiting.

The front display panel 12 comprises a translucent high-impact plastic material, such as that which is well known, for protecting various optoelectronic display elements which are mounted behind the panel 12. In the base unit 100 said optoelectronic display elements include: a large 3-inch high four-by-one character numeric time LED (light emitting diode) panel 30 mounted in the upper portion of the display panel 12 for displaying the current time and various selectable alarm times; a first ½-inch six-by-one character alpha-numeric date LED 32 mounted in the lower left portion of the display panel 12 for displaying the current date; a second ½-inch six-by-one character alpha-numeric alarm status LED 34 mounted in the lower right of the display panel 12, for displaying the enabled status of said at least a preferred alarm time; and a ⅛-inch eight-by-three character alpha-numeric duration LED 36 mounted in the lower center of the display panel 12 between the date and alarm status LEDs 32 and 34, for displaying the selected duration of the alarm delay and the selected maximum number of times an activated alarm may be delayed.

FIGS. 1B and 1C illustrate an embodiment of the exterior of an alarm clock remote controller 200, comprising a portable palm-sized substantially flattened ovoid molded plastic housing 50 including a top face 51 and a bottom face 52, a left side 53, a right side 54, a large rounded first end 55 and a second end 56 also rounded and of a smaller radial dimension than the first end 55. The left and right sides 53 and 54 of the remote controller housing 50 further comprise a continuous side wall connecting the top and bottom faces 51 and 52, such that each elongate edge of the side wall is connected to a corresponding elongate edge of the top face 51 and the bottom face 52 of the housing 50, and the left and right sides 53 and 54 together completely encircle the top and bottom faces 51 and 52. The smaller second end 56 comprises a transmitter cowling 57, for containing means for transmitting an alarm delay signal. On the bottom face 52 and on each side adjacent to the transmitter cowling 57 is located a recessed key: on the left side a recessed time set key 58 providing means for selecting for adjustment either the current hour or current minute, and on the right side a recessed time adjust key 59 providing means for adjusting the selected time parameter. The top face includes a large push-button type remote alarm-delay key 60 which operates means for generating and transmitting an alarm delay signal, and a display panel 62 for displaying the current time. The display panel 62 comprises a translucent cover for protection of a ¼-inch four-by-one character numeric clock element LED 64 for displaying the current time. The bottom face 52 further includes a sliding cover 65 for allowing access to the replaceable battery power source means for the remote controller 200.

Initial application of electrical power to the present alarm clock system, from either connecting the alarm clock base unit 100 to line alternating current, or placing of the back-up battery in the alarm clock base unit 100, activates a powerup reset feature, which causes flashing of the time LED panel 30 and date LED 32, on which are indicated the current time and date. Operation of the alarm clock system is activated by the user pressing the TDSS key 14, which enables adjustment of the current hour and causes time LED panel 30 to flash only the LED segments representing the current hour. The time LED panel 30 segments continue to flash during a thirty second adjustment period or until the TDSS key 14 is pressed again. During the thirty second adjustment period, pressing the time and date adjustment key 16 causes the hour setting to advance. If the TDSS key 14 is not pressed within thirty seconds, the time and date displayed at the end of the adjustment period become the current time and date. If the user presses the TDSS key 14 within the thirty second adjustment period, the displayed hour becomes the current hour, and adjustment of the next parameter is enabled, which in this embodiment is the current minute. As with the hour setting, the minutes LED segment begins flashing, and the user has thirty seconds within which to adjust the minutes parameter, using the same time and date adjustment key 16, after which period the displayed time and date values become the current time and date. Further depression of the TDSS key 14 enables successive adjustment of the date, month and finally year settings, always using the time and date adjustment key 16 to change the value of the selected parameter. As with the adjustment of the current time, the LED segment representing the unit being adjusted (month, date, etc.) flashes during the adjustment period. Depression of the TDSS key 14 after any thirty second period of inactivity enables successive adjustment of the various time and date parameters, including the hour, time, date, month and year settings.

Adjustment of the alarm parameters is performed in the same manner as with the time and date settings. Depression of the alarm setting selection key 18 causes flashing of the corresponding LED segment of either the time LED panel 30 or the duration LED 36 which displays the parameter whose adjustment is enabled. In this embodiment of the present invention, successive depression of the alarm setting selection key 18 enables adjustment of, in order, the first preferred alarm time hour, the first preferred alarm time minute, the second preferred alarm time hour, the second preferred alarm time minute, the alarm delay duration period, and the maximum number of times that the alarm delay may be activated. The values of the parameters are adjusted by depression of the alarm adjustment key 20. The setting of a preferred alarm time is displayed on the time LED panel 30 while its value is being adjusted. After said adjustment, the LED panel 30 resumes display of the current time. Similarly, the alarm delay duration period and the maximum number of times that the alarm may be delayed are displayed on the duration LED 36 only during the adjustment period. This display is normally off.

The alarm clock system of the present invention may be set to a plurality of preferred alarm times, as described above. A preferred alarm time is both selected and enabled simultaneously using the alarm select/enable key 22, such that successive depression of the select/enable key 22 enables the first preferred alarm time, the second alarm time, and finally, may be used to disable the alarm. The enabled status of either the first or the second preferred alarm time is displayed by the front panel alarm status LED 34, which includes means for displaying the enabled status of either alarm. If no alarm is enabled, the alarm status LED 34 is inactivated.

After activation of an audible alarm signal, the user may terminate said signal by pressing alarm aleactivation key 24. Alternatively, the user may operate the alarm delay feature of the present invention. The alarm clock system of the present invention includes duplicate means for operating the alarm delay feature. The first means for delaying operation of the alarm are located on the alarm clock base unit 100, and said means may be activated by pressing the local alarm-delay key 26, which generates an electronic alarm delay signal. This aspect of the alarm delay is substantially similar to a "snooze button" which is well-known in the art. Unlike the prior art, however, the alarm clock system of the present invention also includes the remote controller 200 with remote alarm-delay key 60 for remotely operating the alarm delay feature. When the remote alarm-delay key 60 is pressed, an alarm delay signal is generated and transmitted from the remote controller 200 for receipt by the alarm clock base unit 100. The base unit 100 includes means for receiving and transforming the remotely generated alarm delay signal into the electronic alarm delay signal required for activating the alarm delay feature. The electronic alarm delay signal causes the operation of the audible alarm to cease for a preset period of time, which, as described above, is set-able by the user. After said preset time period, the audible alarm resumes operation.

In addition to the remote alarm-delay feature, the alarm delaying means of the present invention further comprises means for limiting to a preselected maximum amount the number of times the continued operation of the audible alarm can be delayed respective to a preferred alarm time. After activation of the audible alarm at said preferred alarm time, the electronic alarm delay signal may be activated a plurality of times, until said preselected maximum amount is reached. After said maximum amount is reached and the subsequent delay period has ended, the audible alarm resumes operation and disregards any additional electronic alarm delay signals, for the purpose of requiring the operator to move to the base unit 100 in order to press the alarm deactivation key 24 and thereby disable the audible alarm.

Referring to FIG. 1B, the remote controller 200 further includes means for setting and displaying the current time. When the recessed time set key 58 is depressed and held, adjustment of the current hour is enabled and the LED segment of the clock element LED 64 displaying the current hour flashes to indicate this condition. Depression of the time adjust key 59 while the time set key 58 is being held causes the displayed hour to advance, and the current hour is set when both keys are finally released. If the time set key 58 is depressed twice in rapid succession and held after the second operation of said key 58, adjustment of the current minute is enabled and the LED minute segment flashes to indicate this condition. As with the hour setting, depression of the time adjust key 59 while the time set key 58 is being held causes the displayed minute to advance, and the current minute is set when both keys are released. While an LED display is desirable because of its nighttime visibility, such displays consume a large amount of electrical current. Because of this, the clock element LED 64 is normally disabled while the current time is kept by an internal clock unit of the remote controller 200. Pressing the remote alarm delay key 60 causes the current time to be displayed on the clock element LED 64, for a period of 10 seconds, after which period said LED 64 is turned off. It is important to note, and will be further described below, that pressing the alarm delay key 60 both activates the current time display on the remote controller, and simultaneously generates and transmits an alarm delay signal to the base unit. However, alarm delay signals, either local or remote, are not processed by the alarm delay means of the base unit 100 unless the audible alarm has been activated at a selected preferred alarm time.

Figure 2A:
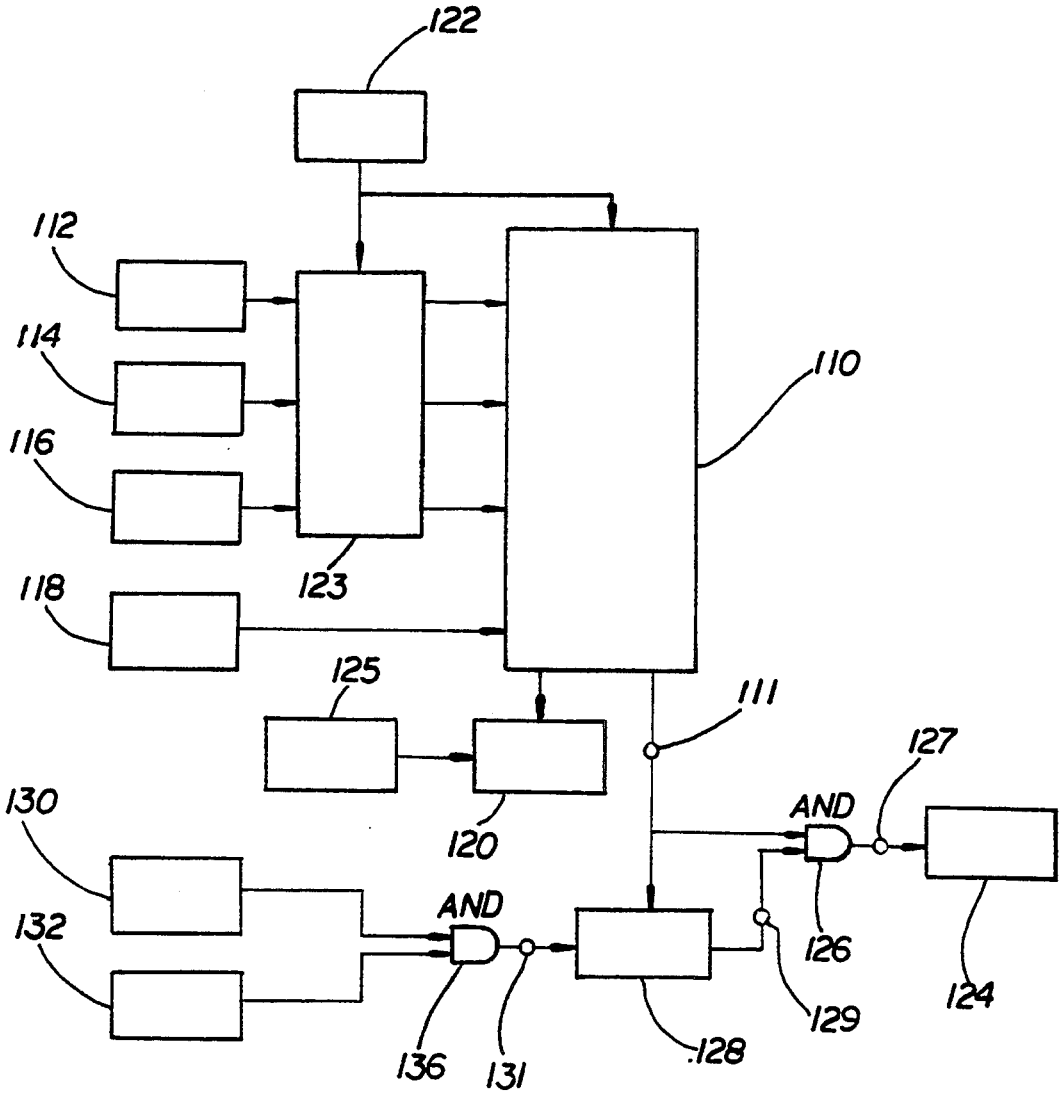
FIG. 2 is a schematic block diagram of the electronics underlying the principal elements of an embodiment of the alarm clock system according to the present invention.
Figure 2B:
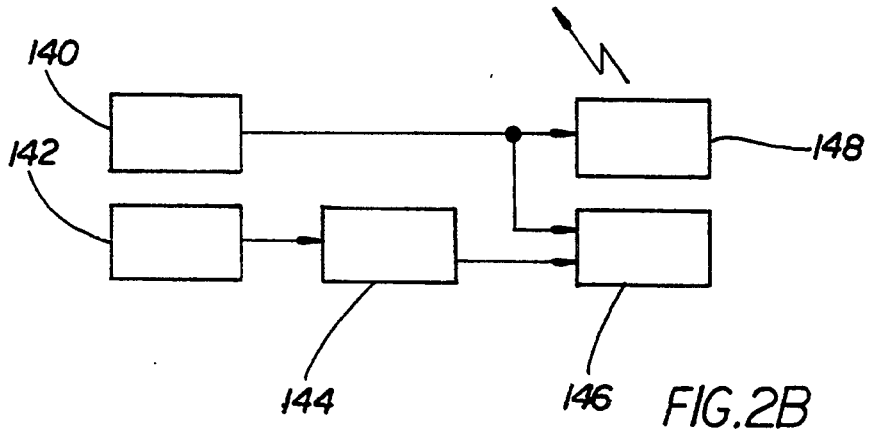

In FIG. 2 is illustrated a functional block diagram of an embodiment of the logical circuitry used to enable the features described above, with a diagram of circuitry for the alarm clock base unit 100 depicted in FIG. 2A and a diagram of circuitry for the remote controller 200 depicted in FIG. 2B. It can be seen that the center of the alarm clock system is a standard alarm clock module 110 such as is well known in the art, to which modifications have been made in order to enable the novel features of the present invention.

The standard alarm clock module 110 incorporates at least electronic means for adjustment and keeping of the current time and date, means for adjustment of at least a preferred alarm time, means for enabling and disabling said at least a preferred alarm time, means for generating an electronic alarm signal, and LED display driver means 120 associated with the various LED's of the display panel 12. Integrated circuits that incorporate all of these features, and often including additional features, are well known in the art. Interfaced to the clock module 110 are current time and date setting means 112 associated with the TDSS key 14 and the time and date adjustment key 16 (FIG. 1A); alarm time setting means 114 associated with the alarm setting selection key 18 and the alarm adjustment key 20; alarm activation enabling means 116 associated with the alarm select/enable key 22, for enabling activation of the audible alarm at a selected preferred alarm time; and alarm deactivating means 118 associated with the alarm deactivation key 24. Still further included in the base unit 100 is means for adjusting the display brightness 125, which is associated with the control wheel 28. Said means are well known in the art, requiring only selection of the components that best accommodate external factors such as cost and desired reliability. In the event that line-supplied power is removed or absent, such as due to a power failure, a backup battery 122 can provide for continued operation of the clock module. Also shown in FIG. 2A is non-volatile storage module 123 such as is well known in the art, for retaining alarm system parameters as well as the current time and date when the base unit 100 is disconnected from a power source. This module is also connected to the backup battery 122.

Assuming that a preferred alarm time has been enabled, the alarm output signal 111 is low (a logic 0, or FALSE) until the current time is the same as the enabled alarm time when the alarm output signal undergoes a transition from low to high (logic 1 or TRUE). The alarm signal 111 is connected to suitable audible alarm means 124, such as a buzzer, through the first input of a two-input AND gate 126, and is also connected to alarm delay logic 128. The transition of the alarm output signal from low to high sets the output 129 of the alarm delay logic 128 to high, so that when the alarm is activated, both inputs to AND gate 126 are high, which sends the output 127 of AND gate 126 high, thereby activating the audible alarm 124. The alarm output signal 111 remains high until the alarm is deactivated by the alarm deactivation means 118. Operation of the delay feature of the present invention causes the output 129 of the alarm delay logic 128 to change from high to low, which causes a low signal to appear on the output 127 of AND gate 126, disabling the audible alarm 124.

Figure 3:
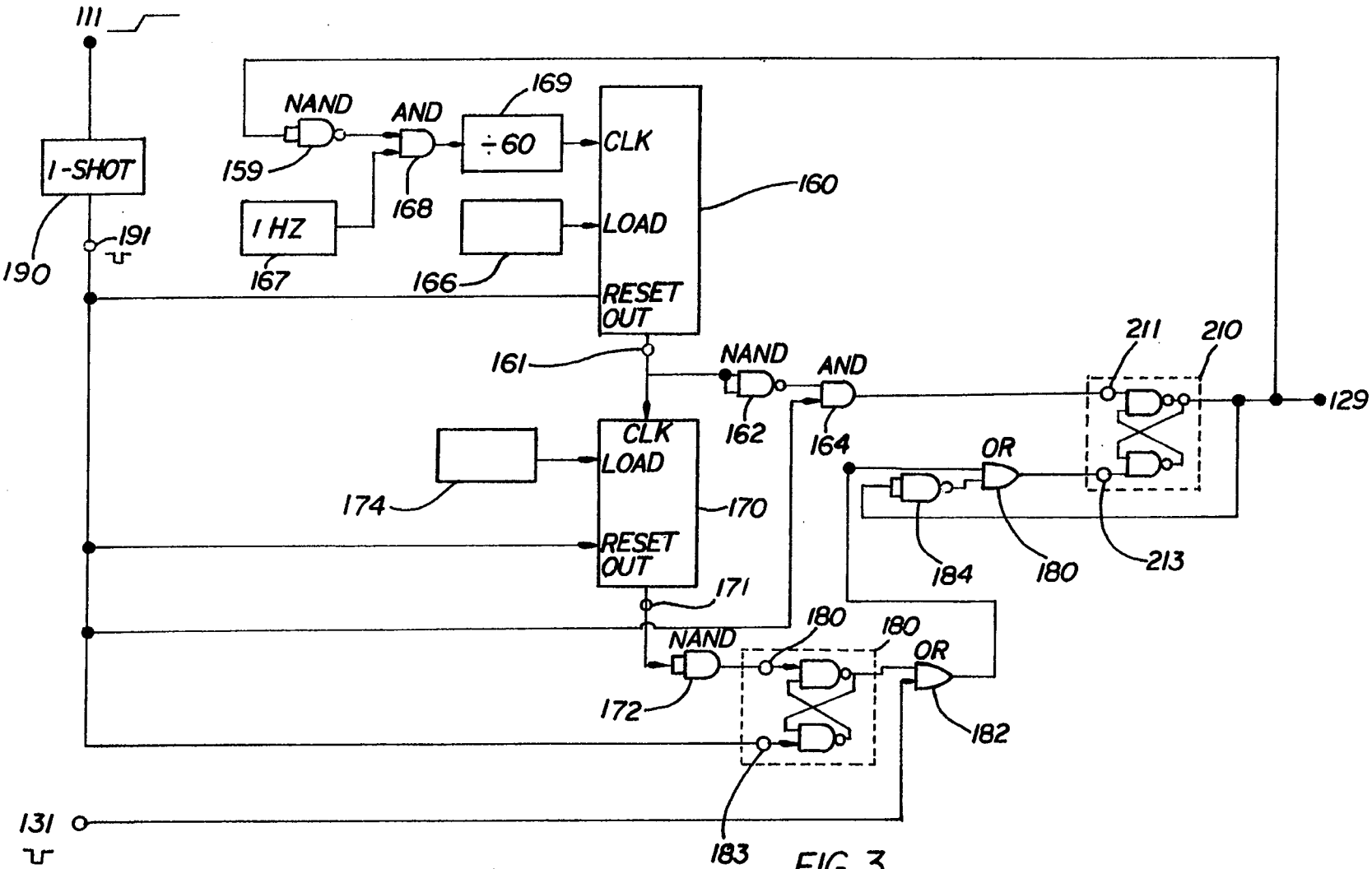
FIG. 3 is a logic diagram of the circuitry used to implement the embodiment of the alarm clock system alarm delay functions according to FIG. 2.

The alarm delay logic 128, which is illustrated in greater detail in FIG. 3, is activated by an electronic alarm delay signal 131, which emanates from either the base unit delay means 130 when the local alarm delay key 26 is depressed, or from the remote delay signal receiver/decoder 132, upon receipt of a delay signal transmission from the remote controller 200. The electronic alarm delay signal 131 comprises a brief high-to-low pulse, hereinafter referred to as a "low pulse," on a normally high output, and can be generated by either the base unit alarm delay 130 or by the receiver/decoder 132, such that a low pulse from either unit passes through a two-input AND gate 136 and into the alarm delay logic 128. The receiver/decoder 132 provides for communication between the remote controller 200 and the alarm clock base unit 100, such that an alarm delay signal generated and transmitted by the remote controller 200 is received by the receiver and transformed by the decoder, into the electronic alarm delay signal 131.

Referring to FIG. 2B, the functional components of circuitry for the remote controller 200 comprise a remote alarm delay unit 140 associated with the remote alarm delay key 60 (FIG. 1B), a time set unit 142 associated with the recessed time set and time adjustment keys 58 and 59, a clock module 144 capable of maintaining the current hour and minute, LED display driver means 64 associated with the clock element LED 64, and a delay-signal encoder/transmitter 148. As described above, pressing the remote delay key 60 of the remote controller 200 generates an alarm delay signal, here represented by the remote delay unit 140. This unit activates display of the current time by display means 146 and also activates the encoder/transmitter 148, which results in the transmission of an alarm delay signal for receipt by the receiver/decoder 132 of the base unit (FIG. 2A). All of the functions performed by these embodiments of circuitry for the base unit 100 and the remote controller 200 are available as modular circuit components, which those skilled in the art will recognize as being readily obtainable for assembling various embodiments of the present invention and achieving the logical functions described herein.

In the preferred embodiment, the encoder/transmitter 148 is a phototransistor for emitting signals in the infrared range of light frequencies, and the receiver/decoder 132 is a corresponding photodetector, both of which are readily available. However, those skilled in the art will recognize that a wide variety of transmitter-receiver combinations may be provided for use in the alarm clock system of the present invention, including the combinations of a radiofrequency transmitter and receiver, and a sonic transmitter and microphone.

FIG. 3 illustrates in detail the alarm delay logic block 128 of FIG. 2A, in which the alarm output signal 111 and the electronic alarm delay signal 131 are processed to control the alarm delay output 129. Assuming that a preferred alarm time has been selected and enabled before activation of the alarm, the alarm output signal 111 of the alarm clock module 110 is low. In addition, the output 161 of a duration counter 160 is normally low, and the output 171 of a delay counter 170 is also normally low. The low output 161 of the duration counter 160 is inverted by NAND gate 162, resulting in a high level at the first input of AND gate 164. The low output 171 of the delay counter 170 is also inverted, by NAND gate 172, presenting a high level to the (set-high)input 181 of NAND latch 180. (Proper operation of a NAND latch requires normally high inputs.)

Operation of the alarm delay circuitry begins with alarm activation by the alarm clock module 110, which causes signal 111 to undergo a transition from a low level to a high level. This positive transition triggers a monostable multivibrator or "one-shot" 190 which emits a low "reset" pulse 191 on its normally high output. Four reset events occur because of the appearance of the low pulse 191, and are described below.

First, the reset pulse 191 is connected to the reset input of the duration counter 160. The reset pulse 191 ensures that the output 161 is low, and causes the duration counter 160 to begin counting down from any preset value 159 present on the counter 160 load inputs. In this case, the preset value 159 is the alarm delay duration period, in minutes, which is established via manipulation of the alarm setting selection key 18 and the alarm adjustment key 20, as described above. Clocking of the duration counter 160 occurs during an alarm delay period, and is described in greater detail below.

Second, the reset pulse 191 is connected to the reset input of the delay counter 170, which in the illustrated embodiment is the same type of counter used as the duration counter 160. The reset pulse 191 causes the counter 170 to begin counting down from any preset value 174 present on the counter 170 load inputs. Said preset value 174 is the maximum number of times the alarm delay may be activated, as established via manipulation of the alarm setting selection key 18 and the alarm adjustment key 20, as described above. Clocking of the duration counter 170 occurs at the end of each alarm delay period, and is further described below.

The third connection of the reset pulse 191 is to the second input of AND gate 164, and is critical to the operation of the illustrated embodiment. Because the first input to gate 164 is normally high, as described above, the low reset pulse 191 passes through AND gate 164 to the (set-high) input 211 of a NAND latch 210. The output signal from the latch 210 is the delay logic output 129. Activation of the alarm by the alarm clock module 110 causes both the signal 111 to be set high, and the signal 129 to be set high, allowing activation of the audible alarm 124, as illustrated in FIG. 2A. The signal 129 also performs two additional functions. First, while signal 191 resets duration counter 160, it is important to prevent clocking of counter 160 until an alarm delay period has begun. Therefore, a high signal 129 is inverted to a low level by NAND gate 166, which prevents passage of a 1 Hz clock pulse 167 through AND gate 168, to a divide-by-sixty counter 169. Without clocking, no output emanates from the divide-by-sixty counter 169, thus preventing clocking of the duration counter 160. The second additional function of the signal 129 is to allow processing of an electronic alarm delay signal 131 only when the alarm is active, and not during an alarm delay period. Therefore, when the alarm is active, the high signal 129 is inverted by NAND gate 184, to present a low level to OR gate 186, allowing passage of the electronic alarm delay signal 131 through OR gate 186, and into NAND latch 210. Logically, this leads directly to a description of the operation of the alarm delay, which is related to the fourth connection of reset pulse 191.

The fourth connection of the reset pulse 191 is to the (set low) input 183 of the NAND latch 180. Because the (set high) input 181 is normally high, the reset pulse 191 sets the output of latch 180 to low, presenting a low level to the first input of OR gate 182. The presence of a low level on the first input of OR gate 182 allows the electronic alarm delay signal 131 to pass unobstructed through OR gate 182, to the second input of OR gate 186. As just described, the first input of OR gate 186 is set low by activation of the alarm, so the electronic alarm delay signal therefore passes unobstructed to the (set low) input 213 of latch 210. The output 129 of NAND latch 210 is thus reset to a low level, which blocks the alarm signal, and initiates the operation of the next stage in the alarm delay logic.

The low output 129 is then inverted by NAND gate 184, which presents a high level to the first input of OR 186, blocking processing of further alarm delay signals. Next, the low output 129 is inverted to a high level by NAND 166, which allows passage of the 1 Hz clock signal 167, into the divide-by-sixty counter 169. Once per minute, then, the duration counter 160 receives a clock pulse, counting down the minutes of the alarm duration period. With a suitable positive-clocked counter used for the counter 160, the positive pulse which finishes the counting cycle appears on the output 161 of the duration counter 160. This positive pulse is inverted by NAND gate 162, and passes through AND gate 164, which is connected to the (set high) input 211 of NAND latch 210. Signal 129, which was set to low by the alarm delay signal 131, is thus reset to high, and the alarm delay period is over. The high signal 129 is inverted by NAND gate 184, once again allowing an alarm delay signal 131 to pass through OR 186 into latch 210. Finally, note that the positive clock pulse 161 which ended the alarm delay period also is used to clock the delay counter 170, which is of the same design as counter 160 (positive clocked), so that one alarm delay period is counted.

As long as the alarm signal 111 is not deactivated, the electronic alarm delay signal 131 may be used to repeatedly operate the alarm delay circuitry However, each operation of the alarm delay circuitry causes the delay counter 170 to record another delay event. When the maximum number of delay periods has been counted, the clock pulse providing that maximum count appears on the output 171 of the counter 170. This positive clock pulse is inverted to a low pulse by NAND 172, and this low pulse is presented to the (set high) input 181 of NAND latch 180. The output of latch 180 is thus set to a high level, which causes the output of OR gate 182 to remain high regardless of any alarm delay signals occurring on signal 131. No further alarm delay periods can be processed, then, until a new reset pulse 191 is presented to the (set low) input 183 of latch 180. Reset pulse 191 only occurs due to a transition of signal 111 from low to high, which only occurs once per alarm activation period, at the beginning of alarm activation. Alarm deactivation returns line 111 to a low level, and when a new alarm signal occurs, the reset pulse 191 is generated again by the one-shot 190, resetting the alarm delay circuitry for processing new alarm delay signals.

These various embodiments incorporate at least the most notable improvements of the present invention, namely: an alarm clock system that allows gradual but eventually complete transition to wakefulness, while minimizing the likelihood of premature permanent deactivation of the alarm: this advantage being achieved by novel portable remote control means that are used to delay the operation of an activated alarm signal. Furthermore, these advantages are facilitated by the inclusion in the alarm clock system a large display which allows placement of the alarm clock base unit in a convenient, highly visible, aesthetically pleasing location away from the sleeper. Yet another advantage of the present invention is that oversleeping is prevented by limiting the number of times that the alarm delay may be used, respective to initial activation of the audible alarm signal at a selected preferred alarm time.

The inventor has given a non-limiting description of several embodiments of the present invention, to which many changes may be made without deviating from the spirit of the invention. After reviewing these various embodiments in light of the fore-mentioned disadvantages of the prior art alarm clock systems employing means for delaying the operation of an activated alarm signal, those skilled in the art will readily ascertain the unique novelty of the alarm clock system of the present invention. While this invention has been described with reference to illustrative embodiments, this description is not intended to be construed in a limiting sense. Various modifications and combinations of the various embodiments as well as other embodiments of this invention will be apparent of a person skilled in the art upon reference to this description. Furthermore, other changes such as those which are aesthetic, or those which include the substitution of other materials as they become available, which perform substantially the same function in substantially the same manner with substantially the same result without deviating from the spirit of this invention may be made. It is therefore contemplated that the appended claims cover any such modifications and/or embodiments that fall within the true scope of the present invention.

What is claimed is:

1. An alarm clock system, comprising:

an alarm clock base unit including: an audible alarm; first means for setting the current time; first means for displaying the current time; means for setting at least a preferred alarm time; means for displaying said at least a preferred alarm time; means for enabling the audible alarm such that it is activated at said at least a preferred alarm time; means for disabling the audible alarm, means for delaying continued operation of the audible alarm after it is activated, such that the audible alarm ceases operation and remains inoperative during a preset delay period, after which period the audible alarm resumes operation; said delaying means being responsive to an electronic alarm delay signal; means for receiving and transforming a remote alarm delay signal into the electronic alarm delay signal: and first power source means for energizing the various electronic components of the alarm clock base unit: and a remote alarm controller physically independent from the alarm clock base unit and including means for generating and transmitting said remote alarm delay signal, and second power source means for energizing the various electronic components of the remote alarm controller.

2. The alarm clock system according to claim 1, wherein the alarm clock base unit further comprises means for setting the current date, and means for displaying the current date.

3. The alarm clock system according to claim 1, wherein the remote alarm controller further comprises second means for setting the current time and second means for displaying the current time.

4. The alarm clock system according to claim 1, wherein the delaying means further comprises means for limiting to a preselected maximum amount the number of times the continued operation of the audible alarm can be delayed respective to said at least a preferred alarm time, such that after said preselected maximum amount is reached, the audible alarm resumes operation and disregards any additional electronic alarm delay signals.

5. The alarm clock system according to claim 1, wherein the delaying means further comprises means for setting a preferred duration of the delay period during which the audible alarm remains inoperative.

6. The alarm clock system according to claim 1, wherein the transmitting means of the remote controller is a phototransistor, and the receiving means of the alarm clock base unit is a corresponding photodetector.

7. The alarm clock system according to claim 1, wherein the phototransistor transmits signals in the infrared range of light frequencies.

8. The alarm clock system according to claim 1, wherein the transmitting means of the remote controller is a radio-frequency transmitter, and the receiving means of the alarm clock base unit is a corresponding radio-frequency receiver.

9. The alarm clock system according to claim 1, wherein the transmitting means of the remote controller is a sonic transmitter, and the receiving means of the alarm clock base unit is a microphone.

10. The alarm clock system according to claim 1, wherein the alarm clock base unit further includes means for generating the electronic alarm delay signal.

11. The alarm clock system according to claim 1, wherein each display means further comprises an optoelectronic display.

12. The alarm clock system according to claim 1, wherein the display means further include means for adjusting the luminous intensity of the displays.

13. The alarm clock system according to claim 1, wherein the setting means further comprise a first set of key means for selecting a clock system parameter for setting, and a second set of key means for setting the value of the selected clock system parameter.

14. The alarm clock system according to claim 1, wherein the means for enabling the audible alarm at said at least a preferred alarm time further include means for displaying the enabled status of the selected alarm time.

15. The alarm clock system according to claim 1, wherein after activation of the alarm, the audible signal operates continuously for a preset activation period, or until disabled by the disabling means.

16. The alarm clock system according to claim 1, wherein after an alarm delay period, the audible signal resumes operation for the preset activation period or until disabled by the disabling means.

17. The alarm clock system according to claim 1, wherein the alarm clock base unit further comprises means for adjusting the intensity of the audible alarm.

18. The alarm clock system according to claim 1, wherein the alarm clock base unit further comprises means for retaining alarm system parameters such as said at least a preferred alarm time, the duration of the alarm delay period, the preselected maximum amount of times the alarm can be delayed, the current time, the current date, or the enabled status of an enabled said at least a preferred alarm time.

19. The alarm clock system according to claim 1, wherein the alarm clock base unit further includes energy storage means for energizing the clock system parameter retaining means.

20. The alarm clock system according to claim 1, wherein the remote controller second power source means further comprise energy storage means for energizing the various electronic components of the remote alarm controller.

* * * * *